US006460476B1

(12) United States Patent
Abraham

(10) Patent No.: US 6,460,476 B1
(45) Date of Patent: Oct. 8, 2002

(54) BUOYANCY DEVICE

(75) Inventor: Arthur Graham Abraham, Aberdeen (GB)

(73) Assignee: Controlled Variable Buoyancy Systems Limited, Aberdeen (GB)

( * ) Notice: Subject to any disclaimer, the term of this patent is extended or adjusted under 35 U.S.C. 154(b) by 0 days.

(21) Appl. No.: 09/831,993

(22) PCT Filed: Nov. 16, 1999

(86) PCT No.: PCT/GB99/03809

§ 371 (c)(1),
(2), (4) Date: Sep. 21, 2001

(87) PCT Pub. No.: WO00/29285

PCT Pub. Date: May 25, 2000

(30) Foreign Application Priority Data

| | | |
|---|---|---|
| Nov. 16, 1998 | (GB) | 9825042 |
| Feb. 15, 1999 | (GB) | 9903319 |
| Sep. 3, 1999 | (GB) | 9920779 |

(51) Int. Cl.[7] ..... B63C 7/00
(52) U.S. Cl. ..... 114/52
(58) Field of Search ..... 114/52, 54

(56) References Cited

U.S. PATENT DOCUMENTS

| | | | | |
|---|---|---|---|---|
| 2,870,730 A | * | 1/1959 | Bruno | 114/54 |
| 4,357,890 A | | 11/1982 | Anderson | 114/123 |
| 4,498,408 A | | 2/1985 | Otteblad et al. | 114/52 |

FOREIGN PATENT DOCUMENTS

| | | |
|---|---|---|
| FR | 1379553 | 3/1965 |
| GB | 2 131 749 | 6/1984 |
| GB | 2 157 628 | 10/1985 |
| WO | 97/43172 | 11/1997 |

* cited by examiner

*Primary Examiner*—Jesus D. Sotelo
(74) *Attorney, Agent, or Firm*—Drinker Biddle & Reath LLP

(57) ABSTRACT

A buoyancy device is described as comprising one or more buoyancy members, such as inflatable bags, diaphragms, bladders or chambers, for attachment to a structure to be floated or sunk such as a drilling rig. In one embodiment, the buoyancy member comprises a restriction device, such as a substantially rigid tubular, and an inflatable member located substantially within the restriction device, such that the restriction device restricts inflation of the inflatable member. In another embodiment, the buoyancy member comprises a substantially flexible portion and one or more end portions, where the end portions may be dome shaped, the or each end portion being releasably attached to the flexible portion.

21 Claims, 17 Drawing Sheets

A - Air supply/venting ext. plug
B - Bottle recharging ext. plug
C - Automation cable inlet (for master module only)
D - Automation plug to link slave modules

BUOYANCY DEVICE

This application is the U.S. national phase application PCT International Application No. PCT/G99/03809 filed Nov. 16, 1999.

The present invention relates to a buoyancy device particularly, but not exclusively, for attachment to large structures requiring to be lifted, lowered, positioned and transported via the ocean.

Conventionally, when an offshore drilling structure comes to the end of its working life, it is decommissioned. In the past, it was thought that decommissioning could entail sinking the drilling structure at the point where it once stood.

However, amongst other factors, environmental factors have recently increased the need for offshore drilling structures to be moved to shallower and calmer waters, or back on land so that the drilling structures can be dismantled safely.

Previously, moving the drilling structures has involved the use of flat back barges, onto which the drilling structures are hauled. However, these barges are expensive and costly in terms of man power requirements.

Our previous PCT application GB97/01350 concerns a type of buoyancy device upon which the present invention seeks to improve.

According to one aspect of the present invention there is provided a buoyancy device comprising at least one buoyancy member optionally connected to a coupling member for attachment of the coupling member to a structure to be floated or sunk, wherein the buoyancy member is inflatable and comprises a substantially flexible portion and one or more end portions, the or each end portion being releasably attached to the flexible portion.

The end portions may be dome-shaped, and the flexible portion may be tubular and may extend between two end portions. The dome-shaped end portions may be arranged in a first configuration in which their convex portions face one another, or may be arranged in a second configuration in which their concave portions are facing one another. The end portions may be connected together by any suitable connector, eg by straps or chains etc. The connectors may have tensioning devices incorporated in order to alter the tension and this can in some embodiments be carried out when the end portions are connected in situ. The end portions can have ports to allow access to the interior of the device.

The end portions can be connected to the flexible portions, for instance, at a section of overlap between the two portions. The flexible portion preferably overlies a respective end portion at said overlap, but this may be reversed. The flexible portion can be hooked onto the end portion, or in a preferred embodiment has bands extending around the flexible portion at the overlap, so as to tighten the band around the flexible portion and compress it against the end portion. One or more bands can be provided, preferably of steel or plastics material, and preferably of an inextensible material.

Another aspect of the invention provides a buoyancy device comprising an array of buoyancy members connected to a coupling member for attachment to a structure to be floated or sunk, wherein the coupling member is disposed at one or more ends of the buoyancy members.

In this embodiment the coupling member can be a plate extending between at least two buoyancy members at an end thereof. The plate can be a simple bar extending between two members which can be adjacent, or can be a lattice which connects a number of adjacent or nonadjacent members in the array.

According to a third aspect the present invention provides a buoyancy device comprising a coupling member for attachment to, or arrangement around, one or more members of a structure to be floated or sunk, the coupling member having at least one coupling point for coupling to a buoyancy member, wherein the coupling member permits the transfer of loads from the buoyancy. device to the member(s) of the structure.

Preferably, the coupling member has a plurality of coupling points for coupling to a plurality of buoyancy members, and preferably to a plurality of respective buoyancy members.

Typically, the coupling member comprises a bore which locates around at least a portion of the outer surface of the member of the structure. Preferably, the said bore is shaped to substantially correspond to the shape of the outer surface of the member of the structure, and where the member is a tubular, the said bore is preferably substantially cylindrical.

The coupling member is preferably arranged to be substantially tubular, and typically, the coupling points are arranged on the outer surface of the coupling member.

The coupling member is preferably arranged to clamp around the outer circumference of the member of the structure, and more preferably, the coupling member is releasably clamped to the member of the structure. Typically, the coupling member is provided with a hinge and/or a locking mechanism to permit the coupling member to be coupled to, and released from, the member of the structure.

A plurality of buoyancy members may be substantially equi-spaced around at least a portion of the circumference of the coupling member, and may be equi-spaced around the whole of the circumference of the coupling member. Alternatively, the spacing between the respective buoyancy members may be variable.

According to a fourth aspect of the present invention there is provided a buoyancy device comprising a buoyancy member for attachment to a structure to be floated or sunk, the buoyancy member comprising a restriction device and an inflatable member located substantially within the restriction device, such that the restriction device restricts inflation of the inflatable member.

The inflatable member can be a bag, a diaphragm or a bladder.

Preferably, the restriction device permits the ingress and/or egress of fluid from within the device, and typically, the restriction device has at least one aperture to permit fluid to flow therethrough. Typically, the buoyancy device is arranged such that water located outwith the restriction device can enter at least a portion of the restriction device and act upon the outer surface of the bag, diaphragm or bladder.

Typically, the restriction device is of a substantially tubular nature.

Preferably, one end of the inflatable bag is secured to one end of the restriction device, and typically, the said one end of the bag is coupled to a fluid inlet and/or outlet port. The bag is preferably formed from a substantially flexible material, and the restriction device is preferably formed from a substantially rigid material.

Alternatively, one end of the inflatable diaphragm or bladder is secured to a portion of the restriction device, which may be the interior of the device and preferably is a portion substantially at the mid-point of the interior of the restriction device, and typically, the said one end of the diaphragm or bladder is in fluid communication with a fluid inlet and/or outlet port. The diaphragm or bladder is preferably formed from a substantially flexible material, and the restriction device is preferably formed from a substantially rigid material. Typically, the one end of the diaphragm or bladder is secured to the restriction device by means of a clamping ring, which typically forms a sandwich of the said one end with the inner surface of the restriction device.

Preferably, the bag is substantially tubular when inflated.

Typically, the inflatable bag is further restrained, along it's longitudinal axis by one or more movement restraining devices, wherein said devices may comprise a substantially elastic ring secured to the outer surface of the bag and preferably secured around at least a portion of the outer circumference of the bag, and a tie which preferably acts between the elastic ring and the interior wall of the restraining device.

Preferably, there are a plurality of apertures formed in the sidewall of the restraining device, and which may be formed in the sidewall along the length of the restraining device. Alternatively, or in addition, there may be one or more apertures formed in an end of the restraining device.

The invention also provides a buoyancy device having the one or more buoyancy members containing an incompressible buoyancy material.

Another aspect of the invention provides a buoyancy device comprising a chamber having a variable buoyancy, and means to vary the buoyancy of said chamber.

The chamber preferably comprises an extensible portion which can be expanded or contracted to increase or decrease the buoyancy of the chamber.

The means to vary the buoyancy of the chamber can be a gas cylinder optionally located in the chamber itself, although this is not necessary. The gas cylinder can be charged with any suitable type of gas more buoyant than the fluid in which the device is to be used. The device can comprise an array of such chambers, or a mixture of variable-buoyancy chambers and other buoyancy members which do not have variable buoyancy means. The device is preferably arranged with an array of buoyancy members comprising an inner ring of members and an outer ring of members, the buoyancy of the outer ring members optionally being non-variable, and that of the inner ring members being preferably variable, but some other arrangement of variable/non-variable members may be used. The buoyancy of the variable members is preferably variable from outwith the device, and for this purpose the device may have external control means.

The buoyancy members can be inflatable and have a substantially flexible portion and one or more end portions, the or each end portion being releasably attached to the flexible portion as previously described.

Typically, the coupling member is a tubular member and the buoyancy members may be coupled along the length of the tubular member, or may be coupled to the ends of the tubular member.

Typically, the tubular member is substantially horizontal in use, when coupled to the structure required to be lifted, and after the buoyancy members have been inflated.

Typically, the tubular member is coupled to the structure when the buoyancy members are deflated.

Preferably, the tubular member is coupled to the structure in an initially horizontal plane.

Alternatively, the tubular member is initially coupled to the structure such that longitudinal axis of the tubular member is approximately 45° to the horizontal plane.

An inflation means inlet and/or a deflation means outlet may be located at one or both of the end portions.

The buoyancy device may further comprise a pressure sensor to sense the pressure in the surrounding water, and may further comprise a displacement sensor to measure the displacement of the buoyancy device, and may further comprise an acceleration sensor to measure the acceleration of the buoyancy device.

A pressure sensor may be provided to sense the pressure within each inflatable member.

Typically, there is provided at least one valve to allow regulation of the pressure within an inflatable member. There may be at least one inflation valve to allow the pressure of air within each inflatable member to be increased and there may be at least one deflation valve to allow the pressure of air within each inflatable member to be decreased.

Preferably, should one or more of the inflatable members deflate, the pressure within the remaining inflatable members may be increased to compensate for the deflated member(s). Preferably, the inflatable members are restrained from over-inflation by a restraining device.

Preferably, the buoyancy device further comprises a control system to allow variation of its buoyancy. More preferably, a number of inflatable members are provided with a control system to allow variation of the buoyancy of the inflatable members.

Preferably, the control system is connected to, and reads signals from, the surrounding water pressure sensor, the inflatable member pressure sensor, the displacement sensor and the acceleration sensor. More preferably, the control system varies the buoyancy of the inflatable member in response to the signals read.

One or more of the inflatable members may be inflated by air. Alternatively, one or more of the inflatable members are inflated with an incompressible material having a density less than that of the surrounding water. Typically, the inflatable members are inflatable bags.

The features of one of the aspects of the invention can readily be combined with features from another aspect of the invention.

Embodiments of the present invention will now be described, by way of example only, and with reference to the accompanying drawings, in which;

FIG. 6(*b*) is a cross-sectional side view of a portion of the buoyancy member of FIG. 6(*a*);

Figure 1:
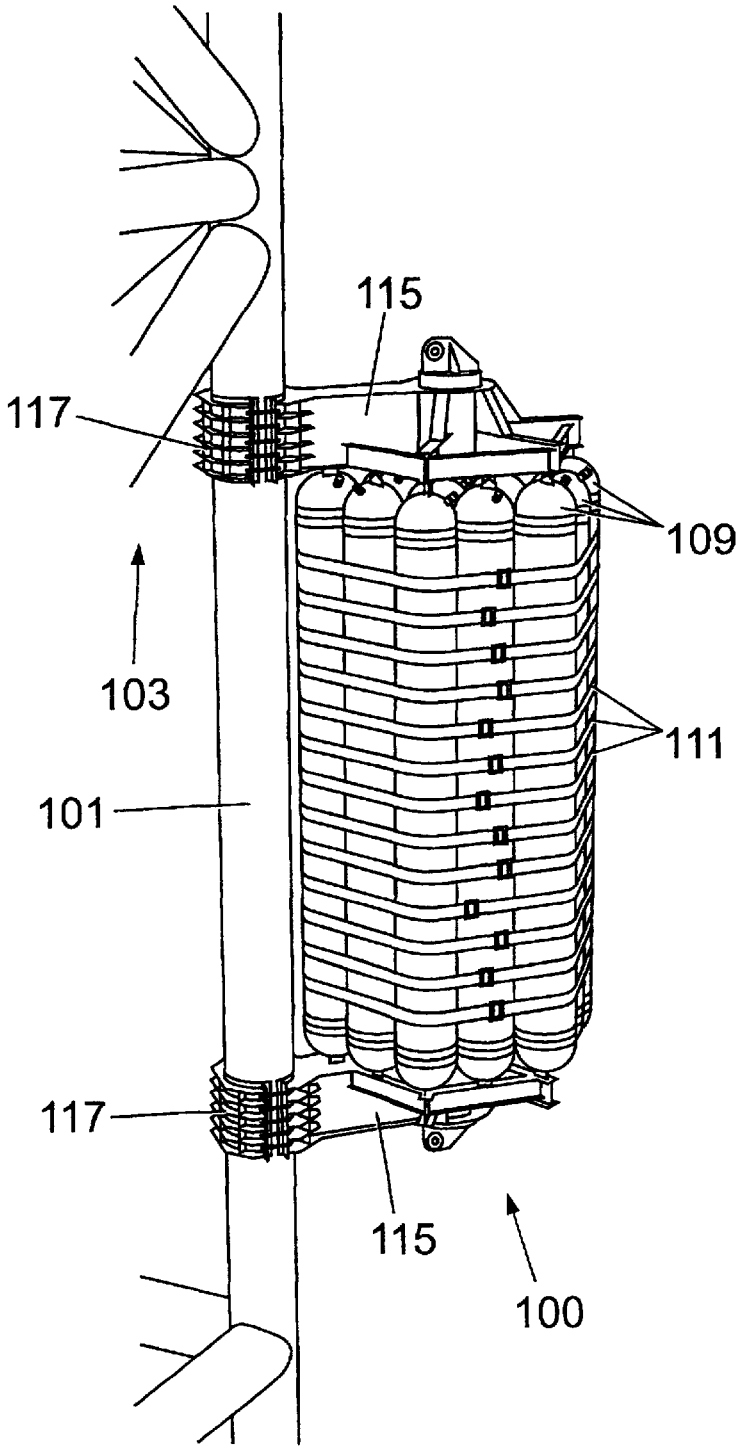
FIG. 1 is a perspective side view of a first embodiment of a buoyancy device in accordance with the present invention.

FIG. 1 shows a first embodiment of a buoyancy device 100 attached in a vertical orientation to a leg 101 of an offshore drilling structure 103 requiring to be lifted up off the ocean floor and moved to a remote location. The buoyancy device 100 of FIG. 1 is primarily a lifting and/or towing device 100, such that when the legs 101 of the drilling structure 103 are cut and the lifting device 100 is inflated, the lifting device 100 raises the drilling structure 103 towards the water surface. Alternatively, the device 100 can be attached to the structure 103 prior to introduction of the structure 103 into the water. In this scenario, when the structure 103 is placed into the water and moved to its desired location, the device 100 can be deflated in a controlled manner as will be described subsequently, such that the structure 103 is sunk.

Figure 8:
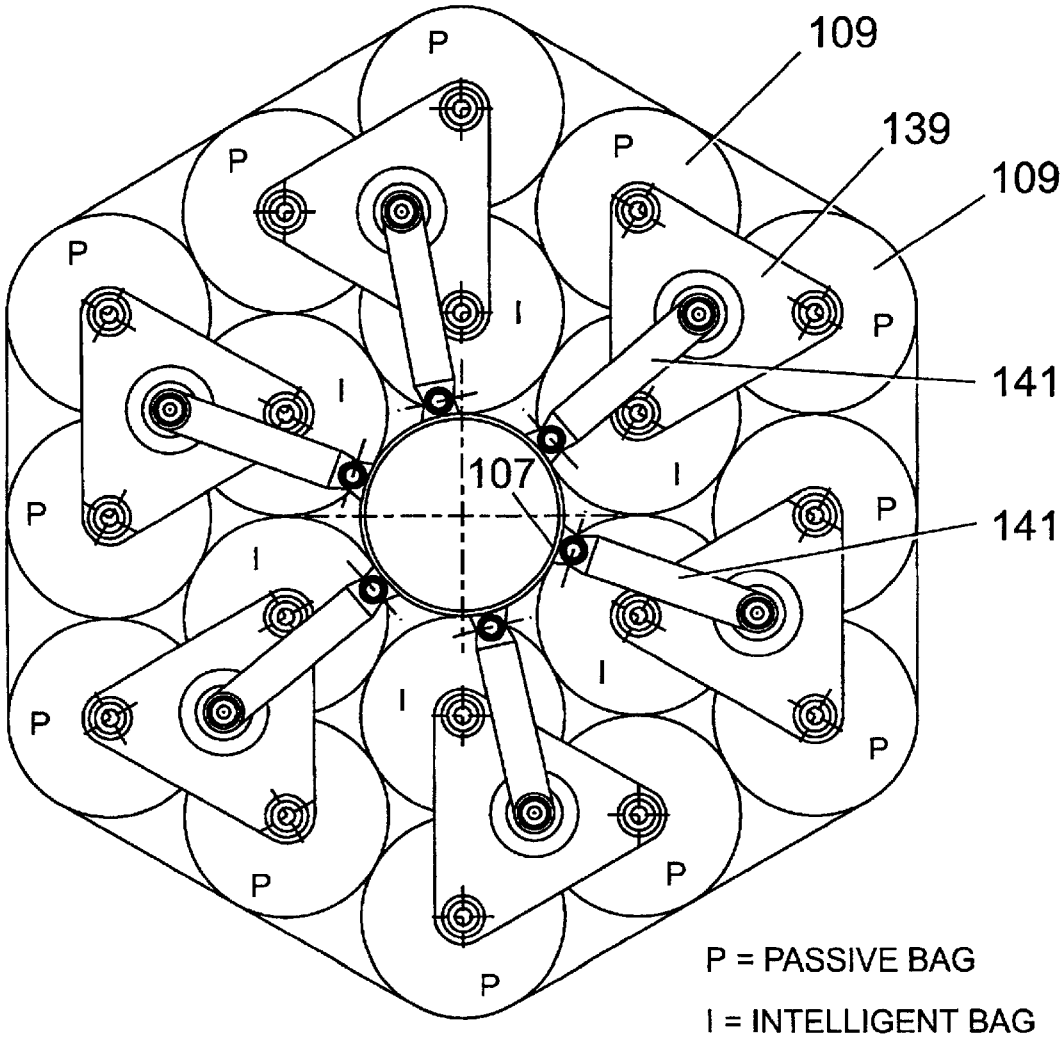
FIG. 8 is an end view of an alternative arrangement, to that shown in FIGS. 1 and 3, of coupling the buoyancy members to a tubular member.
Figure 9:
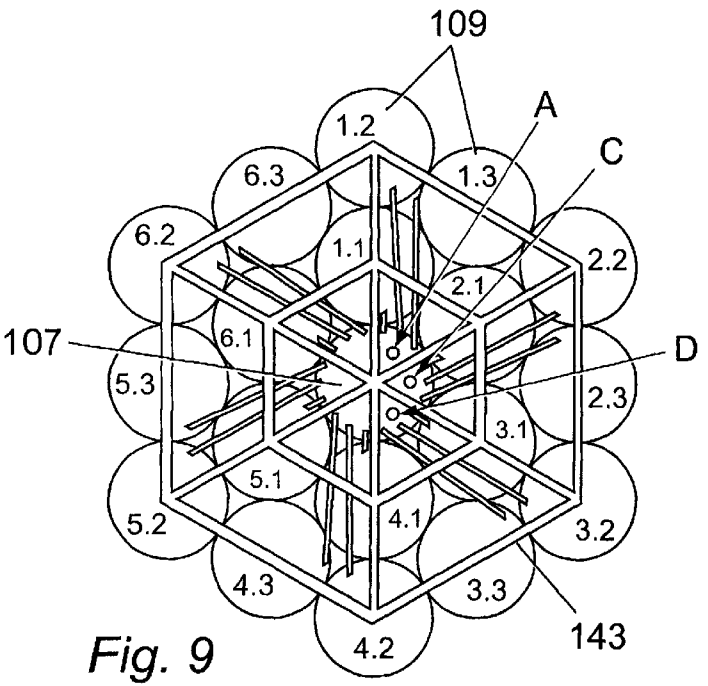
FIG. 9 is a top view of the buoyancy device shown in FIGS. 1 and 3.
Figure 10:
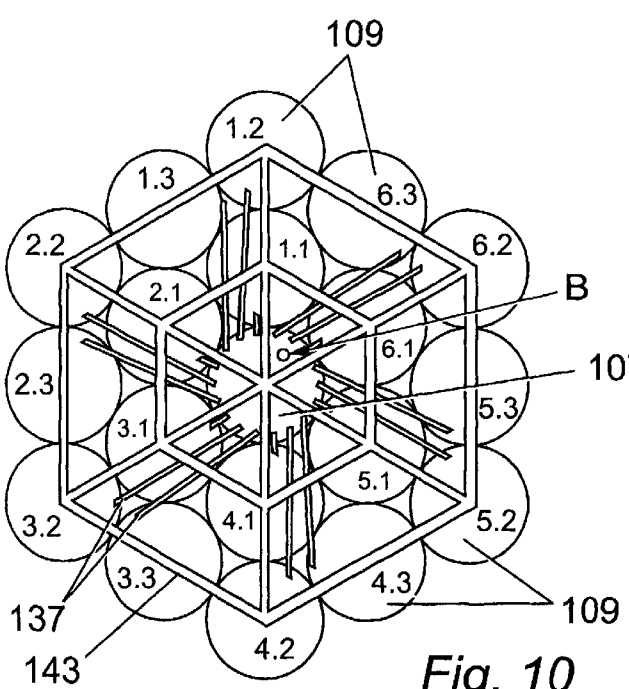
FIG. 10 is a bottom view of the buoyancy device shown in FIGS. 1 and 3.

FIGS. 8, 9 and 10 show the lifting device 100 in more detail. A tubular member 107 is located at the centre of the lifting device 100. Arranged around the circumference of the tubular member 107 are individual bags 109, which are preferably inflatable, and which run the length of the tubular member 107. However, it may be that a tubular member 107 is not required, and thus the presence of the tubular member 107 is optional. The inflatable bags 109 are restrained on their outside surface by webbing straps 111 which strive to keep the inflatable bags 109 in the preferred array arrangement shown in FIGS. 1 to 5 and 8 to 10.

Figure 2:
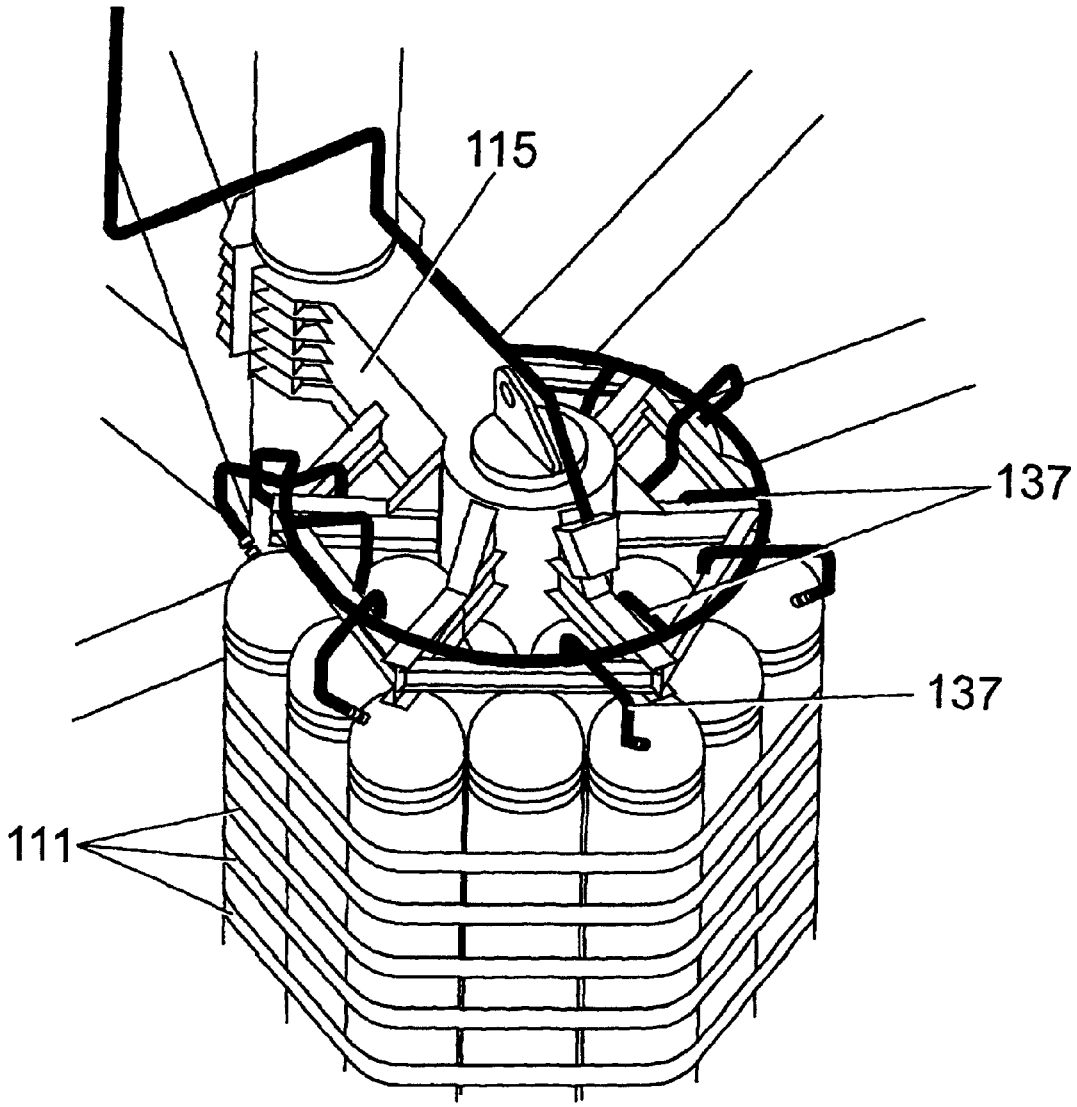
FIG. 2 is a perspective end view of an end view of the buoyancy device of FIG. 1.
Figure 3:
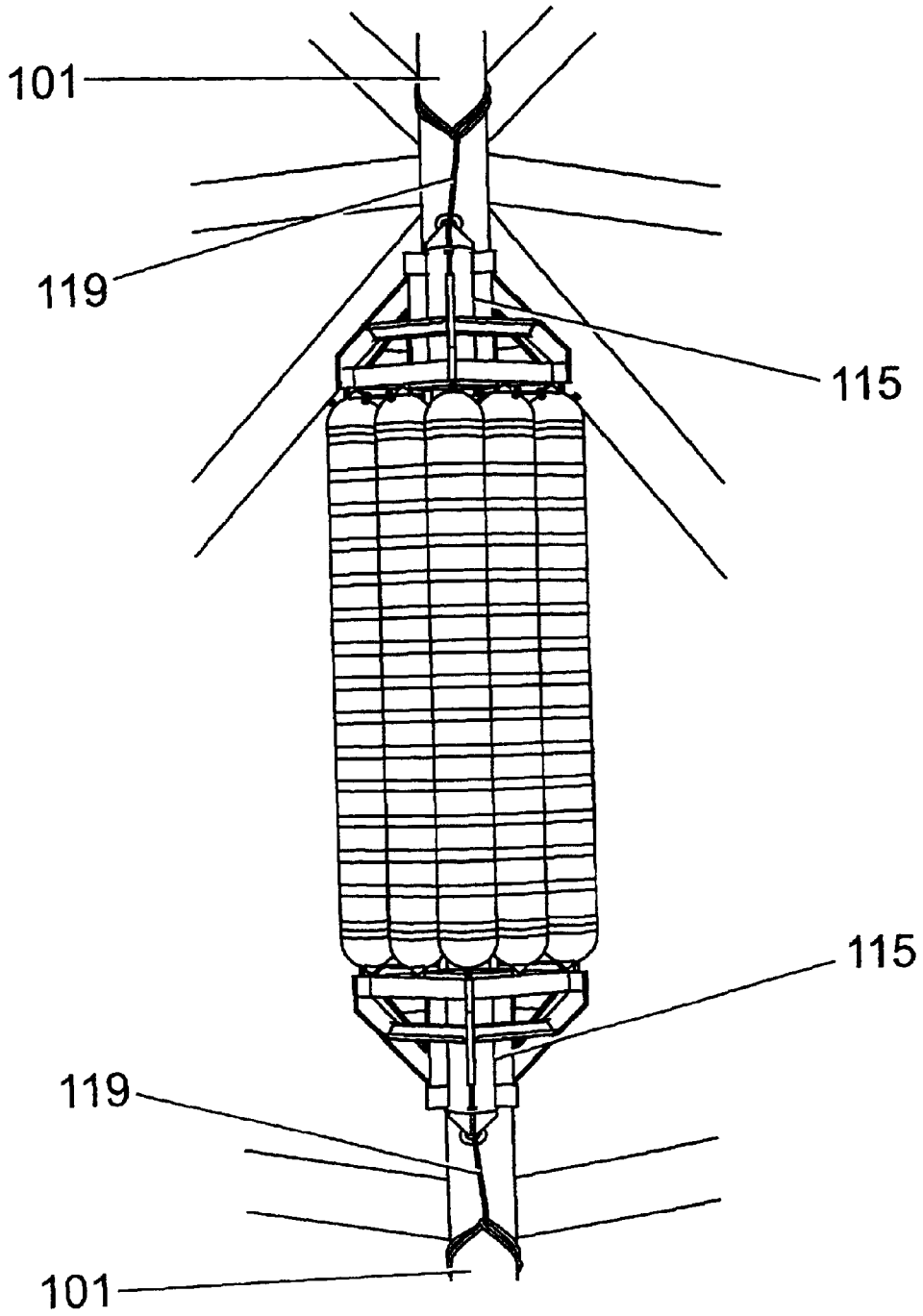
FIG. 3 is a perspective side view of a second embodiment of a buoyancy device in accordance with the present invention.
Figure 4:
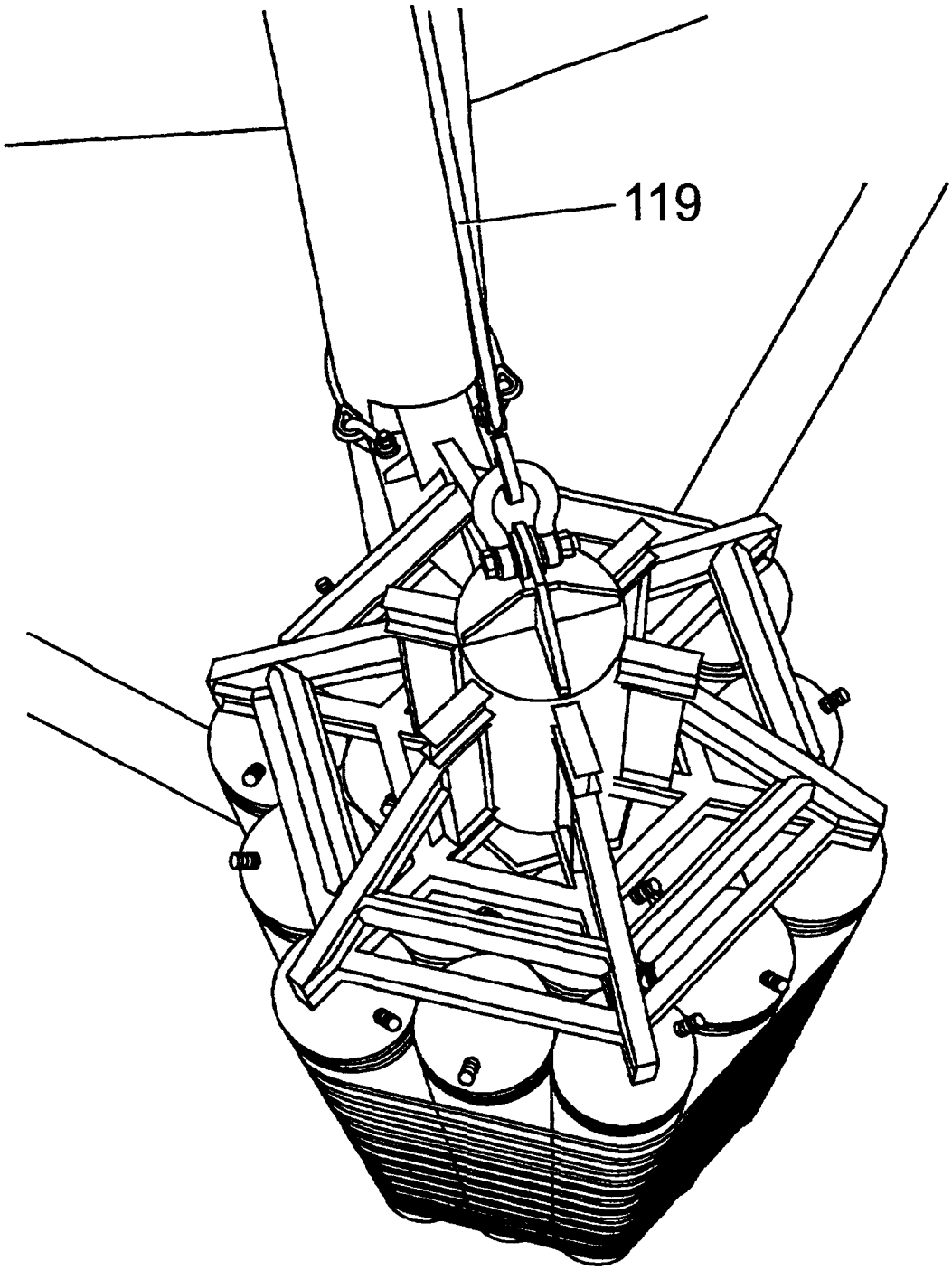
FIG. 4 is a perspective end view of the buoyancy device of FIG. 3.
Figure 5:
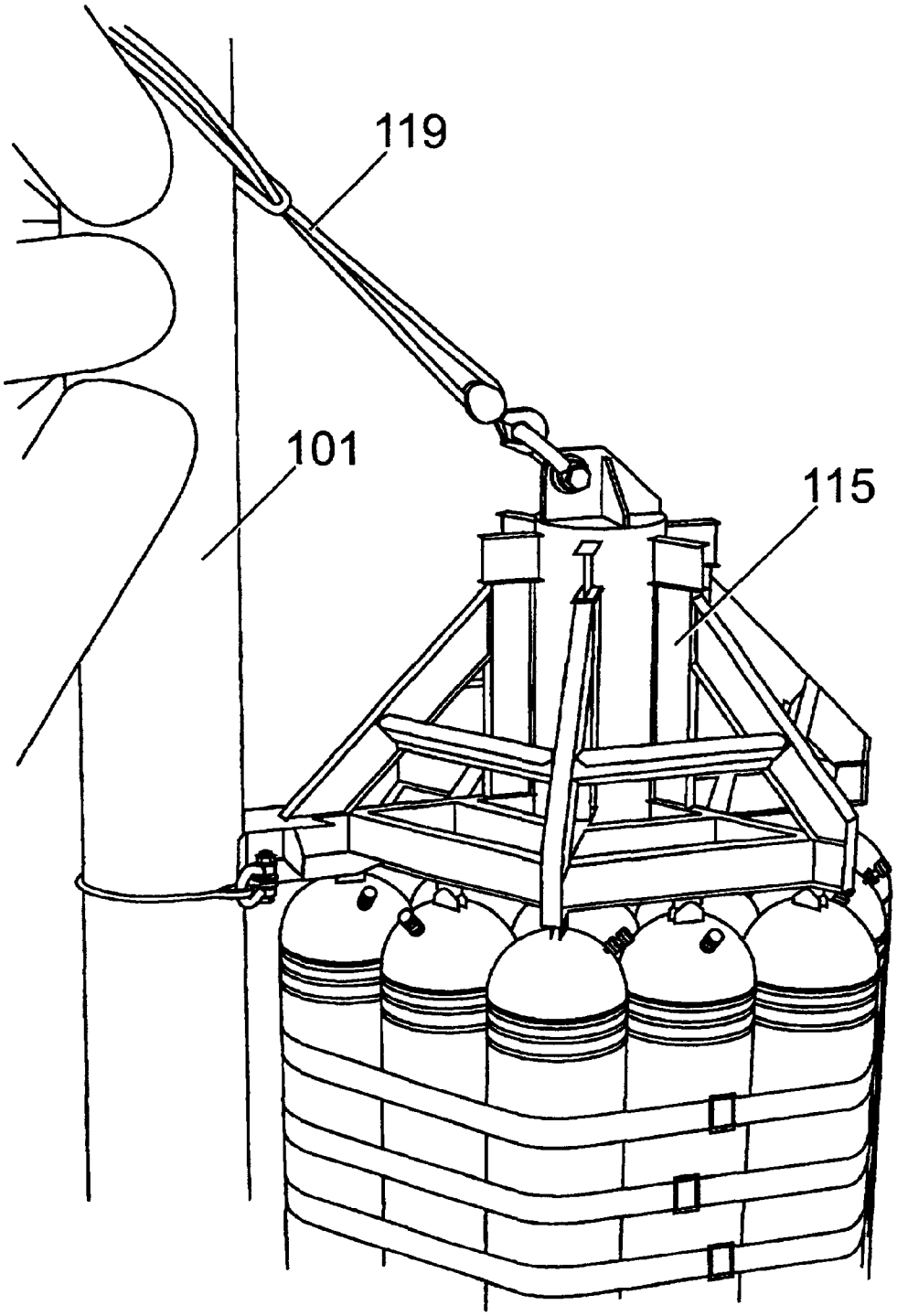
FIG. 5 is a second perspective end view of the buoyancy device of FIG. 3.

Arranged at both ends of the lifting device 100 are end portions 115 to which each of the bags 109 is attached, where the end portions 115 are coupled to the leg 101. FIGS. 1 and 2 show the lifting device 100 being secured to the leg 101 by means of clamping devices 117 which are integral with the end portions 115. The clamping devices 117 can either be formed in a hinge at one side, and screw bolts at the other side, or can be formed in two half shells which are bolted together to form the clamping device 117, or can be formed in any other suitable way. FIGS. 3 to 5 show the lifting device 100 being secured to the leg 101 by means of wires 119 which are tethered to suitable points on the legs 101 and are also secured to the end portions 115.

Figures 6A, 6B:
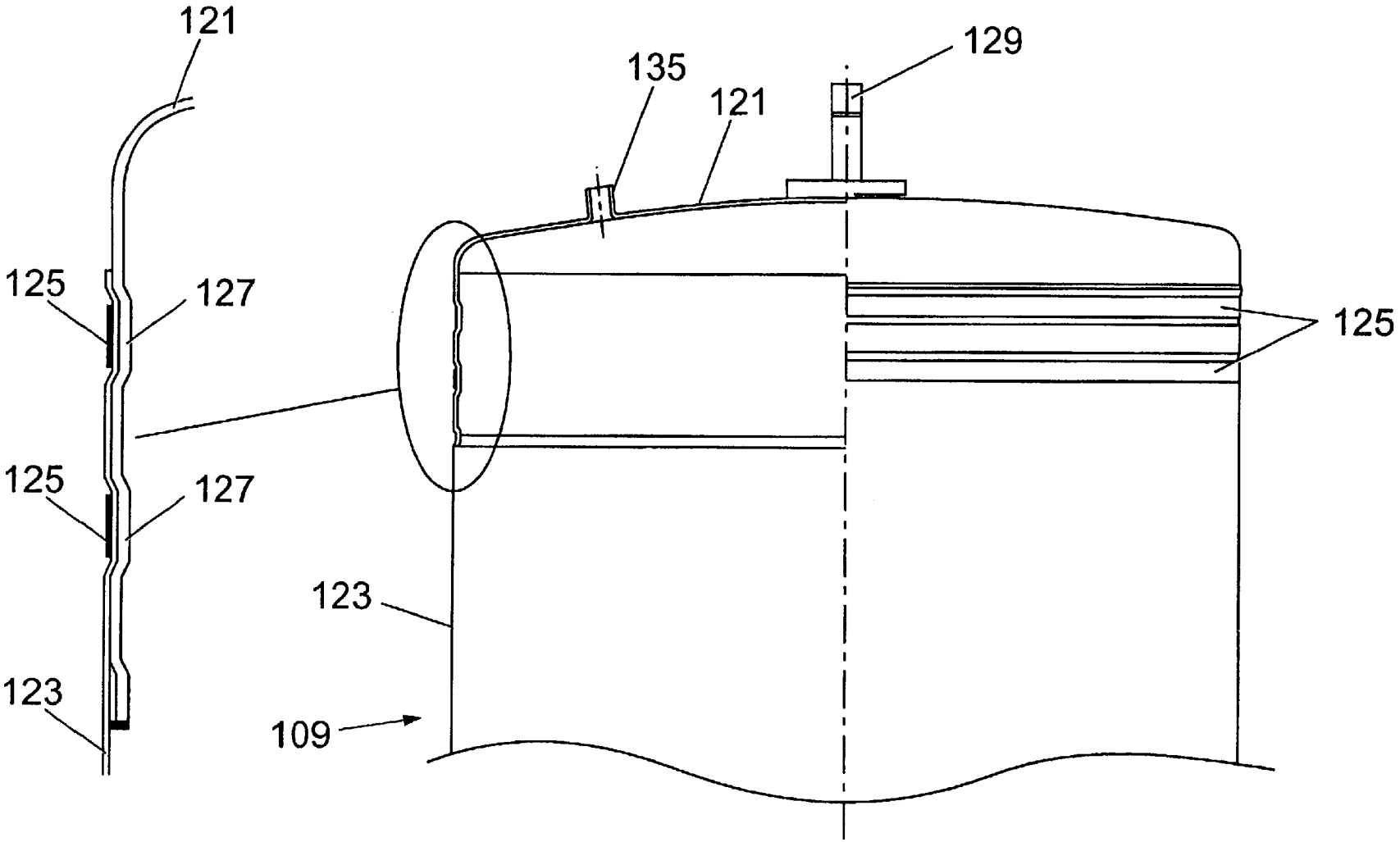
FIG. 6(*a*) is a part cross-sectional side view of a first embodiment of a buoyancy member utilised in the buoyancy device of FIGS. 1 and FIG. 3.

FIG. 6*a* shows the first embodiment of a bag 109, where the bag 109 comprises two end members 121 which are in the form of a dome or dish 121, and a bag portion 123 which is formed from a suitable flexible material which is preferably a woven polyester, polypropylene or nylon, or other suitable impervious material. The dishes 121 are arranged at either end of the bag 109, and the bag portion 123 extends between the end members 121. The dish 121 is shown in FIG. 6*a* as having its convex surface pointing outwardly of the bag 109. The bag portion 123 is coupled to the outer surface of the respective dish 121 by means of retaining bands or straps 125 which are tightened around the overlapping section of the bag member 109 such that the straps 125 locate in grooves 127 formed in the outer surface of the dish 121. The straps 125 are tightened such that the interior of the bag member 109 is substantially watertight with respect to the exterior of the bag member 109. A support pin 129 is provided on the outer surface of the dish 121 for engagement with the framework of the end portion 115.

Figure 7:
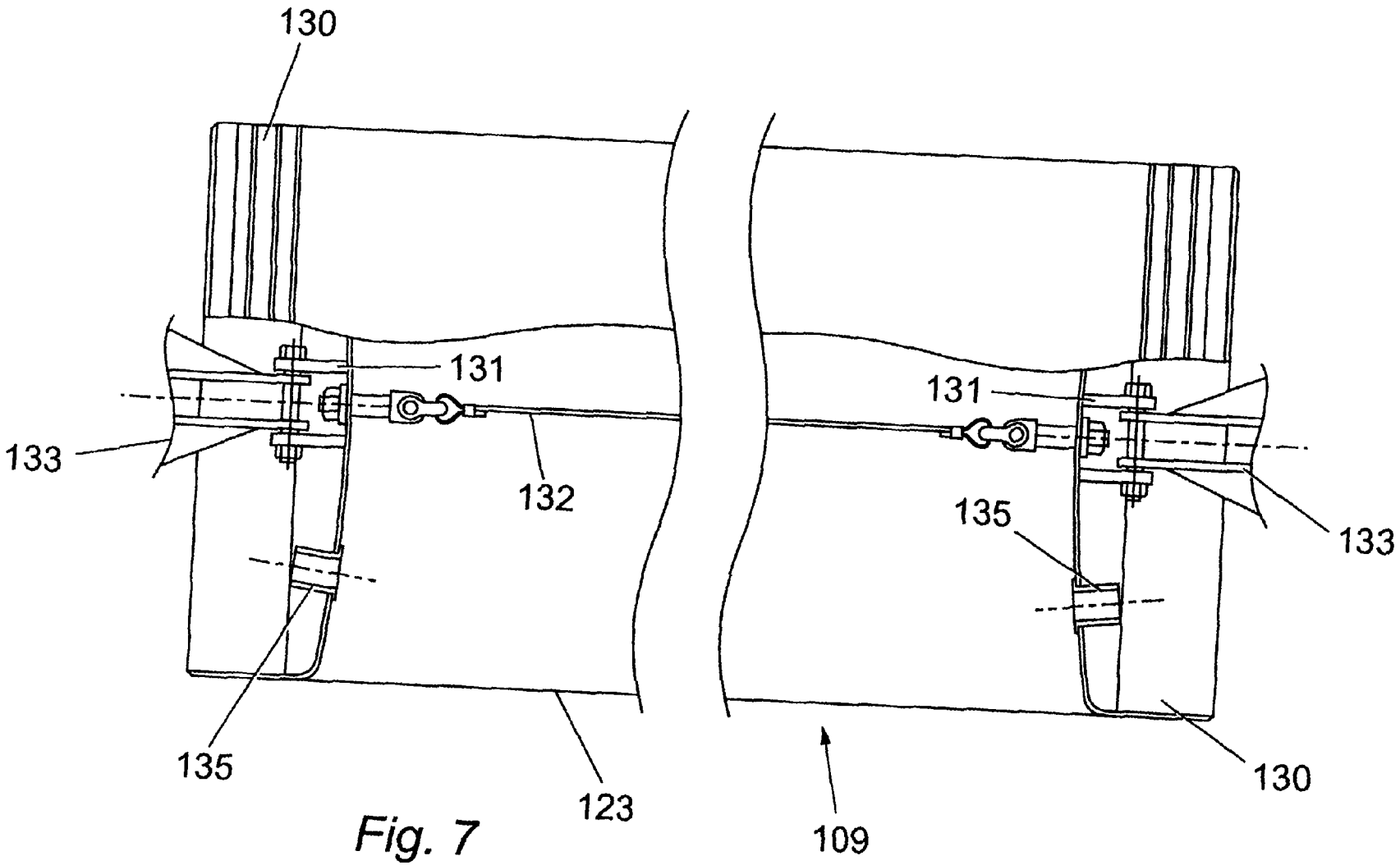
FIG. 7 is a part cross-sectional side view of a second embodiment of a buoyancy member utilised in the buoyancy device of FIGS. 1 and FIG. 3.

FIG. 7 shows a second embodiment of bag member 109, where two dishes 130 are provided at the ends of a similar bag portion 123. However, in this embodiment, the dishes 130 are arranged such that their convex ends point inwardly of the bag member 109. Also, a padeye 131 is provided on the inwardly pointing end of the dish 130, and a strainer cable or strap 132 extends between the two respective padeyes 121. This provides the advantage that when the bag member 109 is fully inflated, the cable 132 resists outward movement of the respective dishes 130. The dishes 130 are provided with support arms 133 on their outer surface for coupling to the frame of the end portions 115.

Service penetrators 135 are provided in the dishes 121, 130 to permit air to be blown into, or withdrawn from, the bag members 109. As shown in FIG. 2, an arrangement of tubes 137 are coupled to the service penetrators 135 and are further coupled to an air supply (not shown).

As shown in FIG. 8, an array of six inner bags 109, and twelve outer bags 109 is provided, where one inner bag 109 may be coupled to two outer bags 109 by means of a triplate 139 which is secured to the support pin 129 or support arm 133 as required. The triplates 139 are further movably coupled to a tubular member 107 via a hinged arm 141, where the hinged arms 141 are equi-spaced around the end of the circumference of the tubular member 107. Accordingly, the triplates 139 and hinged arms 141 form end portions 115.

Alternatively, and as shown in FIGS. 9 and 10, the support pins 129, or support arms 133, are fixed directly to the frame 143 of the end portions 115.

The embodiments described above have the advantage that the end units 115 can be re-used for another lift, and the length of the bag members 123, and cable 132 if present, can be varied to suit a specific lift.

One end of a towing cable (not shown) can be coupled to one or more end portions 115, and the other end of the towing cable is coupled to a tug (not shown), therefore allowing the drilling structure 103 to be towed.

Figure 11:
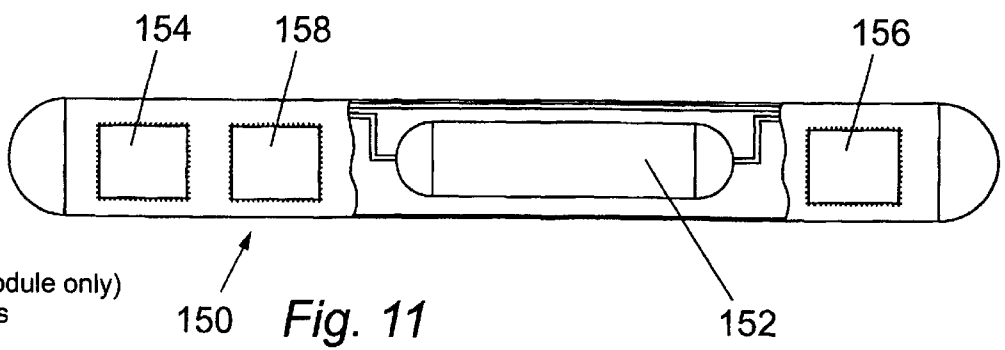
FIG. 11 is a schematic view of a control system for a buoyancy member.

An air supply system 150 is shown in FIG. 11 and is preferably located within the tubular member 107. The air supply system 150 includes an air bottle 152 which initially stores the air which is blown into the bag members 109. The air bottle 152 is coupled to controlled valves provided for one, more than one, or all of the bag members 109, such that via access to inlet 154 and outlet 156 air valves, the level of buoyancy of the individual bag members 109, and thus the lifting device 100 can be controlled. The air supply system 150 is also provided with an access point 158 which provides access to alternation terminal boards, for one, more than one or all of the bag members 109.

In a particularly preferred embodiment, the lifting device 100 can be arranged such that the outer twelve bag members 109 are "passive" bags in that their relative buoyancy is only variable by manual control. However, the inner six bag members 109 are "intelligent" bags in that their relative buoyancy can be altered automatically by the air supply system 150, which is provided with an arrangement of sensors which will now be described.

The tubular member 107 may be constructed from a material having suitable strength and weight characteristics and may be constructed from steel. Alternatively, the tubular member 107 may be constructed from a suitably reinforced plastic material. The dishes 121, 130 are preferably formed from fibreglass, plastic or a metal such as steel or aluminium.

A number of lifting devices 100, as previously described, could be attached to the drilling structure 103 at an angle of approximately 45° to the horizontal plane of the ocean surface, or alternatively could be attached either vertically or horizontally with respect to the horizontal plane of the ocean surface.

The lifting devices 100 are inflated, and lift the drilling structure 103 off the ocean floor, such that the drilling structure 103 is lifted into a tilted towing position, such that the angle of tilt is preferably approximately 45° to the horizontal plane of the ocean surface. The tilted towing position provides a more stable towing position, and provides a greater depth clearance for the bottom of the drilling structure 103.

The air bottle 152 can be supplemented with air by it being connected to a surface air reservoir (not shown) via an umbilical air supply (not shown) by conventional means which are well known in the prior art. Also mounted within the tubular member 107 may be an arrangement of air pressure sensors, displacement and acceleration transducers which together form a transducer array. The pressure transducer typically comprises a diaphragm (not shown) which has a strain gauge (not shown) attached thereto, one side of the diaphragm having a sealed known pressure acting on that side of the diaphragm, and the other side of the diaphragm being open to the ambient pressure of the outside water. An example of a suitable pressure transducer is a DIGIQUARTZ(™) pressure transducer. An example of a suitable displacement transducer is a SIMRAD(™) acoustic tracking system. An example of a suitable acceleration transducer is well known in the art as an accelerometer. Also located within the tubular member 107 may be an acoustic transponder which allows a computer control system mounted on a surface ship to communicate with the control system located within the tubular member 107. An example of a suitable acoustic transponder is an acoustic telemetry system such as a SIMRAD HPR 4000 (™) system. Alternatively, the computer control system can communicate with the control system mounted within the tubular member 107 by means of a hardwire electrical cable (not shown) being connected between the tubular member 107 and the surface ship, whereby the signals to be communicated are multiplexed across the electrical cable, by conventional means well known in the art.

Alternatively, a computer control system may be mounted within the tubular member 107.

The computer control system allows the movement plan of the buoyancy device 100 to be pre-programmed, such that signals from the transducer array are transmitted to the computer control system which monitors the movement of the buoyancy device 100 and can send signals back to the control system to vary the buoyancy of the buoyancy device 100 as necessary.

Power is supplied to the buoyancy device 100 via a power unit which is either located within the tubular member 107 in the form of a battery unit, or is located on a surface ship, and in the latter case the power is supplied from the power unit to the tubular member 107 via an umbilical electrical cable (not shown).

Air is supplied into each inflatable bag 109 preferably by two discrete mechanisms from the air bottle 152. The-first mechanism is an automatic regulation of the inflatable bag 109 through a pressure relief valve mechanism (not shown) which regulates the flow of air supplied from the air bottle 152, since the air bottle 152 will be at a relatively high pressure with respect to the inflatable bag 109. Also, by using this automatic regulation mechanism, a constant flow through of air into the inflatable bag 109 can be maintained, if required, in order to compensate for air leakage from the inflatable bags 109 due to imperfections in the control system and the inflatable bag structure 109. Secondly, there may be an applied regulation mechanism which operates by means of a control valve system (not shown) which regulates the pressure in each individual bag 109 in accordance with the calculated movement plan held within the computer control system. The pressure relief valve mechanism, and the control valve system, which together form an inflatable bag 109 inflation system, are connected in parallel between the air bottle 152 and the inflatable bag 109 air inlet by appropriate air supply conduits (not shown).

The air flow outlet of the inflatable bag 109 is connected to a second pressure relief valve mechanism (not shown) to provide an automatic venting mechanism of the inflatable bag 109 if, in particular when the buoyancy device 100, attached to the structure to be lifted, is raised through the water. This is required because as the buoyancy device 100 is raised, the surrounding ambient water pressure will reduce, but the air pressure within the inflatable bags 109 will remain the same. Therefore, this automatic venting mechanism allows the buoyancy device 100 to be raised slowly without damage to the inflatable bags 109. However, if the automatic venting mechanism through the second pressure relief valve mechanism is not sufficient, then a second control valve system connected to the air outlet of the inflatable bag 109 provides an applied venting mechanism to vent a greater amount of air. The second pressure relief valve mechanism and the second control valve system together form an inflatable bag 109 deflation system.

Each inflatable bag 109 is provided with an individual control system such that the distribution of air flow input and output from the inflatable bags 109 is controlled individually such that each inflatable bag 109 is a discreet subsystem of the overall buoyancy device 100.

The control system for the inflatable bag 109 is a closed loop feedback system, in which the pressure, displacement and acceleration transducers continually measure the pressure being applied to, and the speed and acceleration of the buoyancy device 100. Also measured is the pressure within each inflatable bag 109 by means of a pressure sensor (not shown) located within each bag 109. These measured quantities are then compared to a pre-determined movement plan held within the computer control system and corrections to the actual movement path of the buoyancy device 100 can then be made by controlled operation of the first and second control valve systems.

In addition to the abovementioned buoyancy control mechanism, additional buoyancy control measures can be used. For example, a "bursting disc" may be incorporated into the outer skin of the inflatable bag 109, the bursting disc comprising a metallic disc which will burst when the differential pressure across the metallic disc face reaches a pre-determined level. An example of a bursting disc is a SWAGELOCK(™) bursting disc. Also, by attaching a balance chain, which is well known in the art, the balanced equilibrium of the buoyancy device 100 will be reached at a certain ascent height. Also, a venturi suction system for rapid inflatable bag 109, venting could also be utilised in the buoyancy device 100.

In order to reduce the number of components in the buoyancy device 100, distinct types of inflatable bags 9 may be provided. The buoyancy device 100 may be provided with a combination of the following distinct types of inflatable bags 109. "Passive" inflatable bags are provided with the abovementioned automatic regulation mechanism and the abovementioned applied regulation mechanism, but are only provided with the abovementioned automatic venting mechanism, which obviates the requirement for a relatively expensive applied venting mechanism. Secondly, "intelligent" inflatable bags 109 have the abovementioned automatic and applied regulation mechanisms and the automatic and applied venting mechanisms. This provides the advantage that a number of "passive" inflatable bags can be provided in combination with a number of "intelligent" inflatable bags 109, thereby obviating the expense of a number of applied venting mechanisms. Further, a number of contingency redundant inflatable bags can be provided which have the characteristics of the "intelligent" inflatable bags but are normally redundant, these inflatable bags only operating in the event of compromise to the other inflatable bags 109.

Further, a number of the inflatable bags 109 may be replaced with bags (not shown) which are filled with an incompressible buoyancy material. Examples of such materials are alumina silicate microspheres (a bi-product of the coal fired power generation industry) which contain $CO_2$ gas, bitumen, oil based fluids, fresh water, and other incompressible substances whether fluid or solid which have a density lower than salt sea water which surrounds the buoyancy device. The advantage of providing some of these bags would arise particularly in deploying payloads in deep water. The buoyancy device 100 comprising a number of these bags would be attached to the payload required to be lowered in deep water, such that the payload and buoyancy device 100 combined have a slightly negative buoyancy with respect to the surrounding sea water. Therefore, for a large payload such as a well head Christmas tree, a relatively small crane can be used to deploy the payload.

Figure 12:
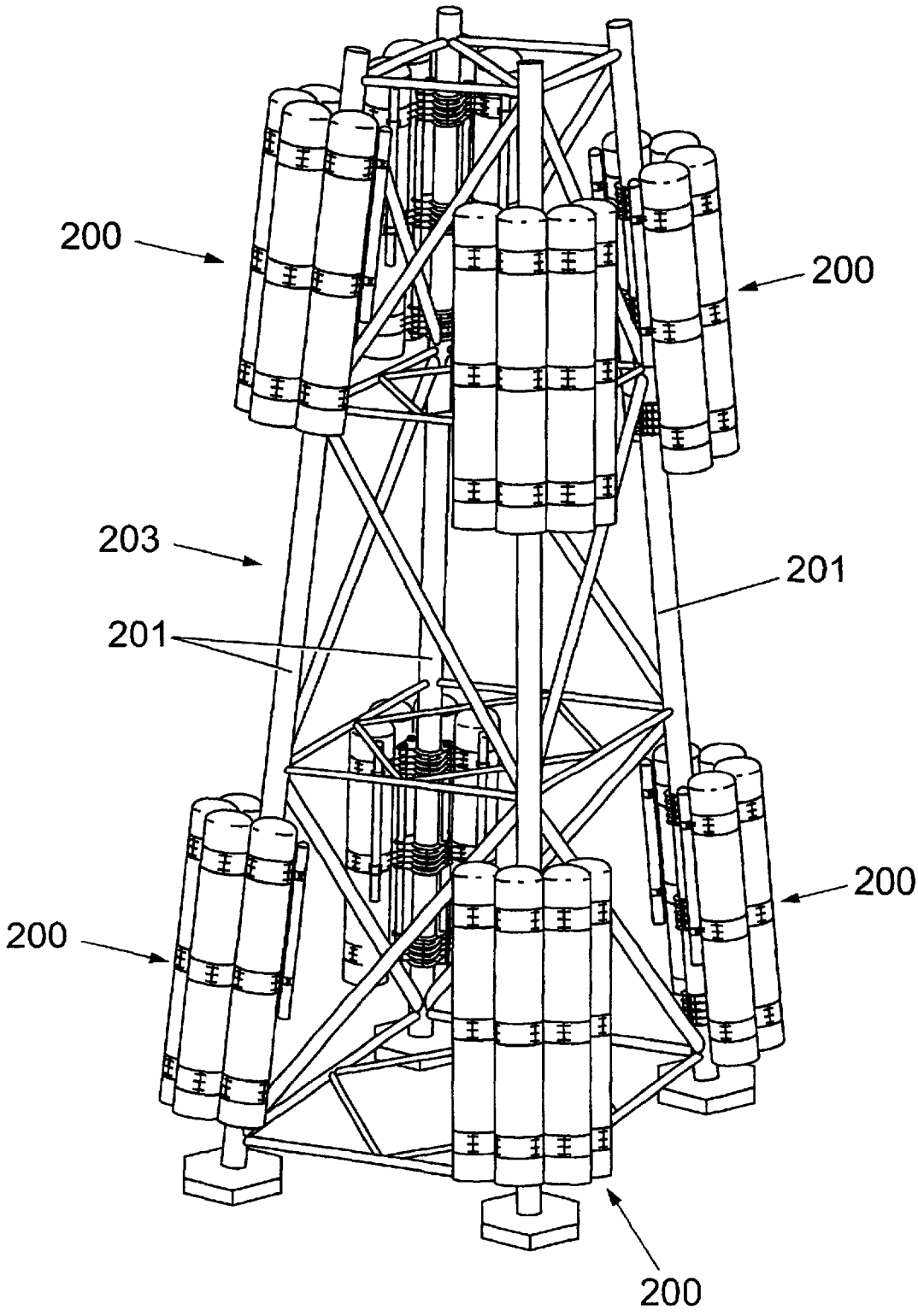
FIG. 12 is a perspective view of a third embodiment of several buoyancy devices in accordance with the present invention.

FIG. 12 shows a third embodiment of eight buoyancy devices 200 attached in a substantially vertical orientation to the legs 201 of an offshore drilling structure 203 requiring to be lifted from the ocean floor and removed to a remote location. The buoyancy devices 200 are used for substantially the same purpose as the buoyancy devices 100 herein described above.

Figure 13:
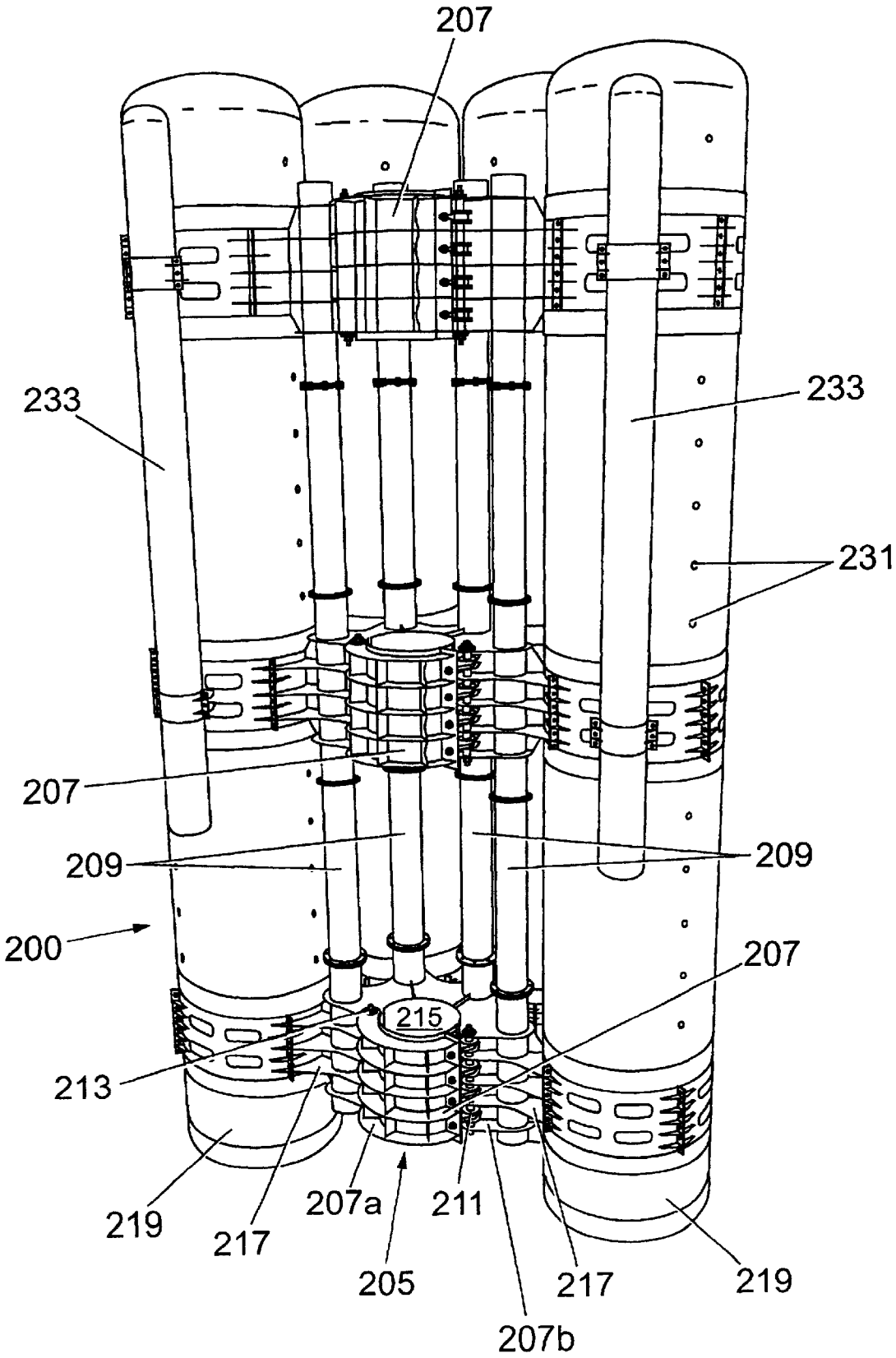
FIG. 13 is a perspective view of one of the buoyancy devices of FIG. 12.

FIG. 13 shows one of the buoyancy devices 200 in more detail. A clamp unit 205 is made up of three clamping devices 207, where the clamping devices 207 are secured to one another by struts 209. The clamping devices 207 are formed from two shells 207A, 207B where the shells 207A, B are preferably coupled to one another by a hinge 211 and a lock 213. However, the shells 209A, B can also be releasably secured to one another by nut and bolt arrangements. The shells 209A, B are formed, such that when they are locked to one another, the clamping device 207 is provided with a throughbore 215 that substantially corresponds in size to the outer circumference of the leg 201. Furthermore, the struts 209 are arranged such that the throughbores 215 of the three clamping devices 207 are aligned.

Each of the clamping devices 207 is provided with a number (in this particular embodiment, 4) of coupling points 217 to permit the clamping devices 207 to be coupled to a preferred number (in this embodiment, 4) of buoyancy members 219 to suit the particular lifting job.

Figure 14:
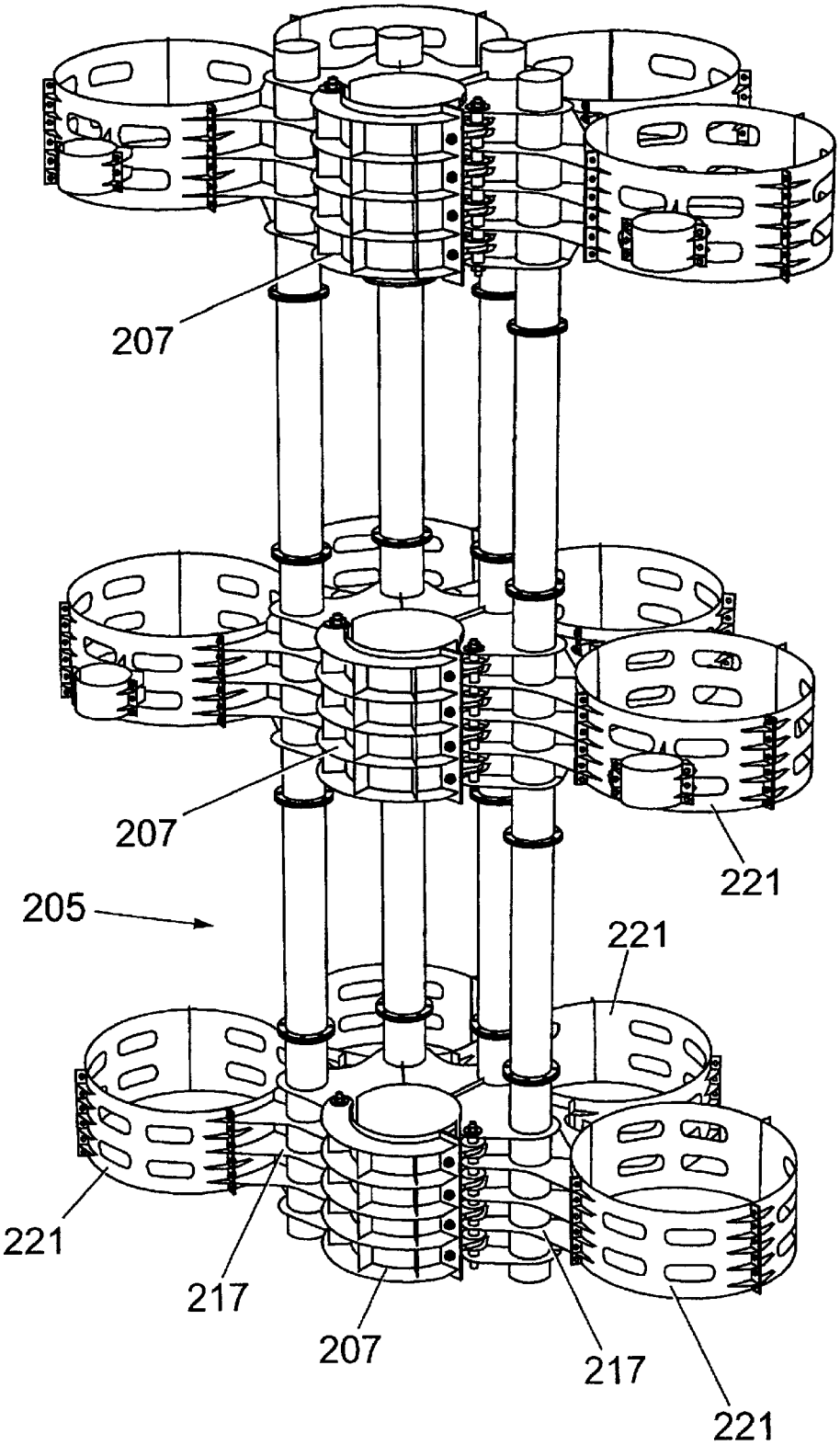
FIG. 14 is a perspective view of a clamping device of the buoyancy device of FIG. 13.
Figure 15:
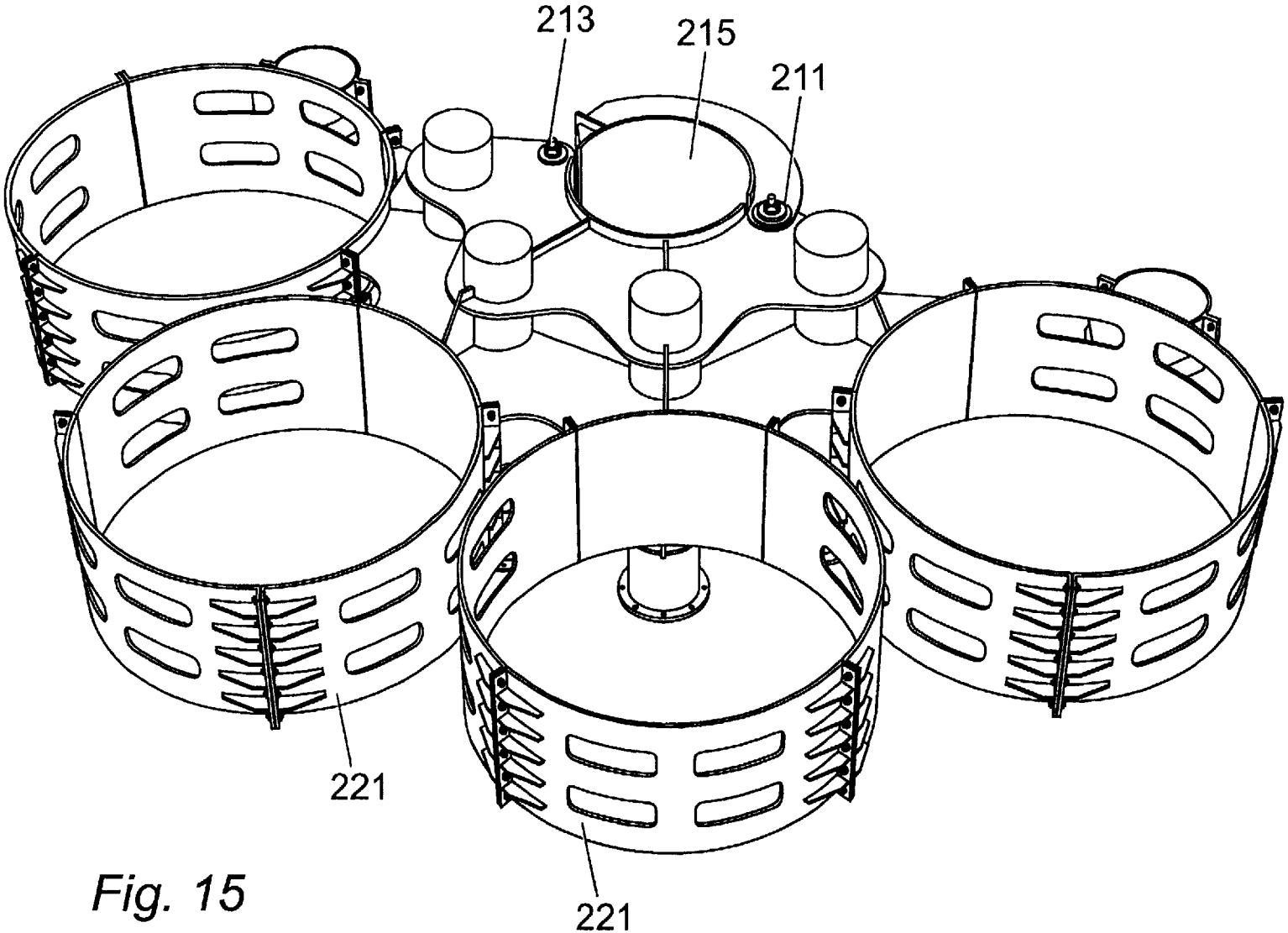
FIG. 15 is a perspective view of a portion of clamping device of FIG. 14.

FIG. 14 shows the clamping unit 205 in more detail, and illustrates that the three clamping devices 207 effectively form a tubular which clamps around the leg 201. A collar 221 is provided at each coupling point 217, where the collar is cylindrical in shape, and secures the buoyancy member 219 therein. As can be readily seen from FIGS. 12 to 15, the clamping unit 205 is preferably arranged such that there are a number of buoyancy members 219 surrounding only a portion of the outer circumference of the throughbore 215. This provides the advantage that the buoyancy devices 200 can easily be attached to the leg 201 of the drilling structure 203, since an ROV or a diver can readily close the shells 209 to lock them together. However, it is possible that more coupling points 217 are provided, for instance around the outer circumference of the shell 207A to provide an enhanced lifting capability.

Furthermore, the collars 221 need not be rigidly coupled to the coupling points 217, and may, for instance, be hinged thereto, to allow the buoyancy members 219 to rotate about the coupling points 217. This would provide the advantage that the buoyancy members 219 could be fanned outwards, after they have been clamped to the leg 201.

Figure 16:
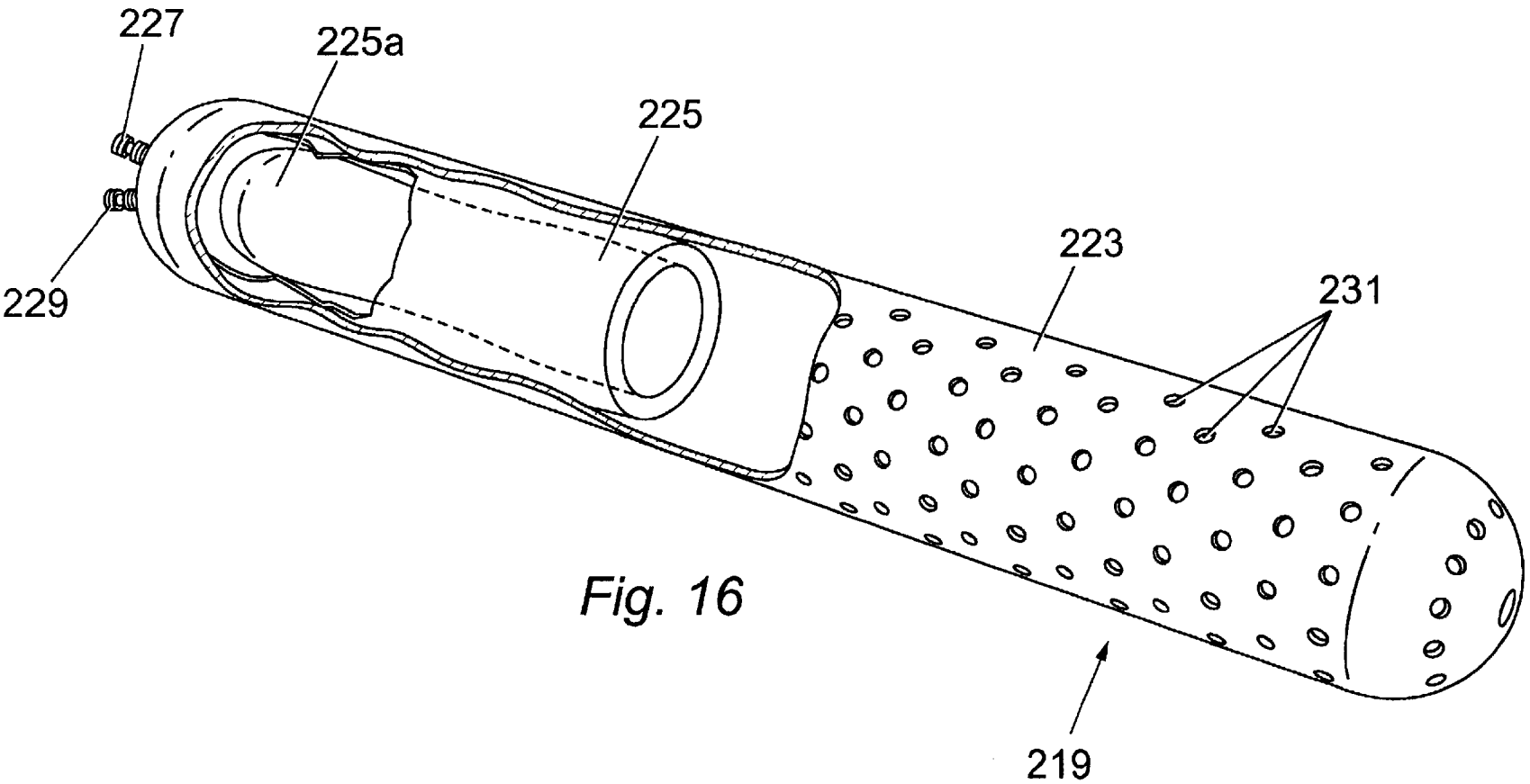
FIG. 16 is a buoyancy member of the buoyancy device of FIG. 13.
Figure 18:
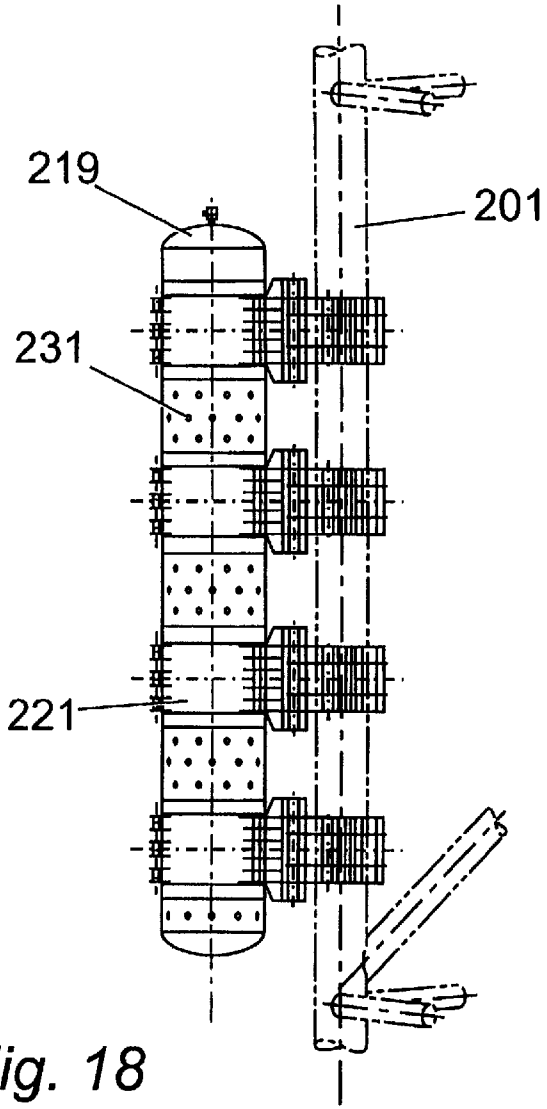
FIG. 18 is a side view of one of the buoyancy members of the buoyancy device of FIG. 13.
Figure 17:
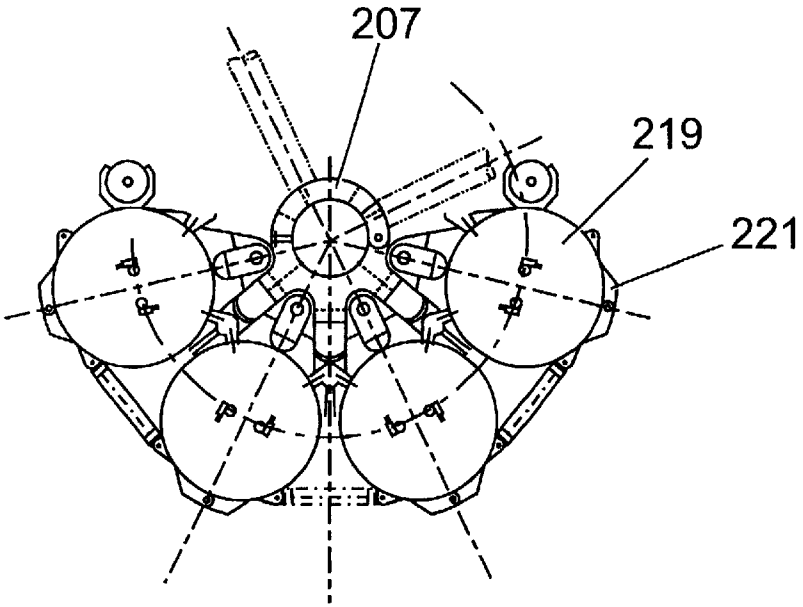
FIG. 17 is a plan view of the buoyancy device of FIG. 13.

FIG. 16 shows one of the buoyancy members 219 in greater detail. The buoyancy member 219 comprises a preferably rigid outer hull 223, which may be formed from a suitable material such as glass reinforced plastic (grp), carbon fibre, or any other suitable material. Located within the hull 223 is an inflatable bag 225, only half of which is shown in FIG. 16. The bag 225 is arranged to lie within the cylindrical hull 223 along its length. One end 225A of the bag 225 is secured to one of the ends of the hull 223, and the end 225A is coupled to an air inlet valve 227 and an air outlet valve 229. Alternatively, a suitable "T" shaped valve could provided instead of the two valves 227, 229 to provide both an air inlet and an air outlet. The bag 225 is preferably provided with elastic rubber rings spaced along its length, where the rubber rings (not shown) are secured to the outer surface of the bag 225. The rubber rings are also secured to the inner circumference of the hull 225 by way of ties (not shown), such that longitudinal movement of the bag 225 within the hull 223 is resisted.

The hull 223 is provided with plurality of apertures 231, although there may be not be as many apertures 231 provided as shown in FIG. 16.

The buoyancy device 219 has the advantage that the hull 223 prevents over-inflation of the bag 225, whilst the apertures 231 ensure that there is no differential pressure between the interior surface wall of the hull 223 and the outer exterior surface wall of the hull 223. Therefore, as the buoyancy member 219 rises to the water surface, the differential air pressure between the air located within the bag 225 and the water located outwith the bag 225 causes the bag 225 to expand radially outwardly. This causes water to exit the interior of the hull 223 through the apertures 231, whilst the hull 223 prevents the bag from overinflating.

Preferably, each buoyancy member 219 is provided with an umbilical airline for inflation of the bag 225, and is preferably also provided with a back-up air-cylinder 233 to permit trimming of the air pressure within the bag 225 by an operator located at the surface.

In addition, the buoyancy members 219 can be provided with a suitable modified air supply system 150 as herein described above. Optionally, the buoyancy members 219 may also be provided with the aforementioned buoyancy control measures, and indeed some of the buoyancy members 219 may be "passive" as hereinabove described.

Figure 20:
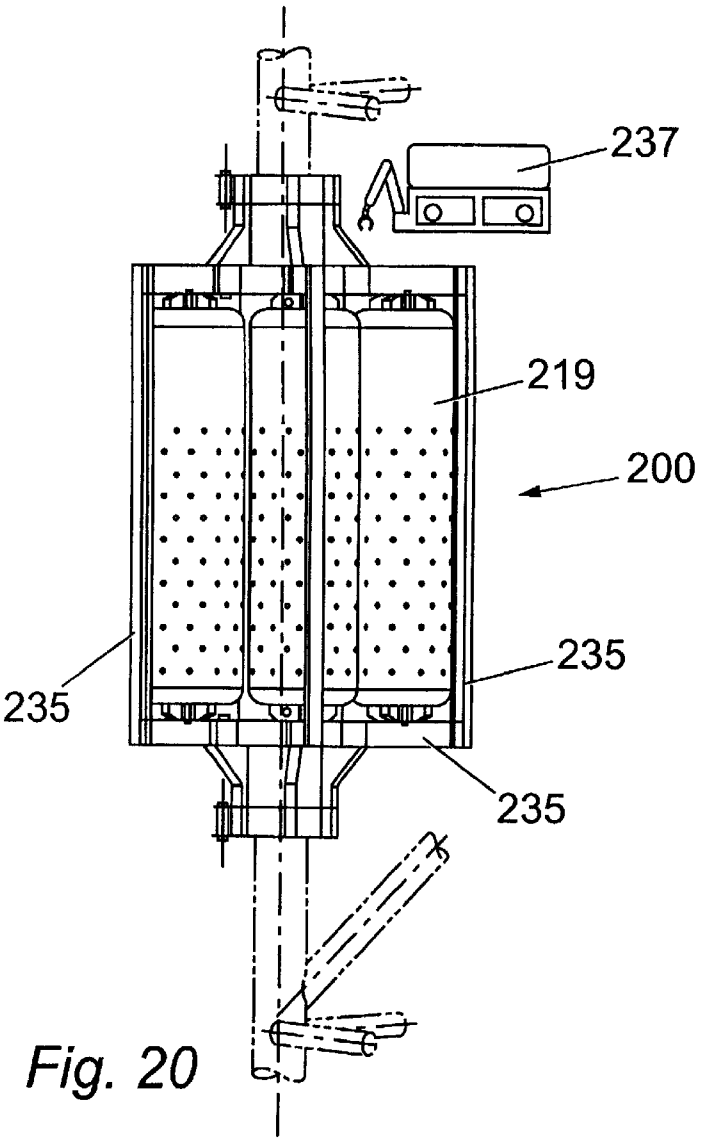
FIG. 20 is a side view of the alternative arrangement of buoyancy members as shown in FIG. 19.
Figure 19:
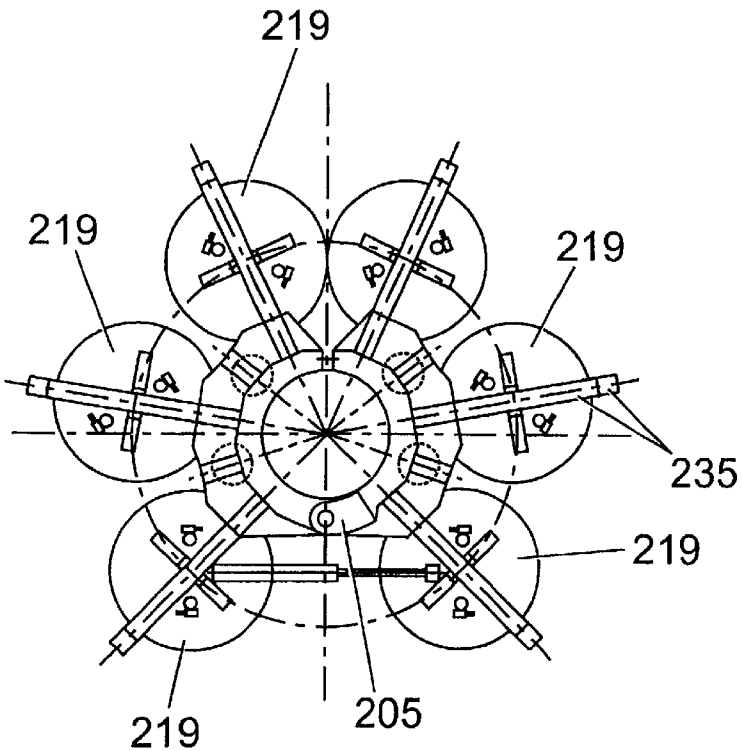
FIG. 19 is a plan view of an alternative arrangement of buoyancy members to that shown in FIG. 13.

FIG. 19 shows the buoyancy members 219 further being housed within a frame 235 to provide extra rigidity to the buoyancy device 200. FIG. 19 also shows that there are five buoyancy members 219 arranged around the circumference of the clamping unit 205; the number and spacing of the buoyancy members 219 can be varied around the circumference of the clamping unit 205 as required. As shown in FIG. 20, an ROV 237 can optionally be used to operate hydraulically the hinge 211 of the clamping unit 205 to close the two shells 209A, B together.

The buoyancy device 200 has the advantage that the clamping unit 205 permits the transfer of loading from the buoyancy members 219 to the leg 201 of the offshore structure 203. Furthermore, the rigid hull 223 prevents over-inflation of the inflatable bags 225.

Figure 21:
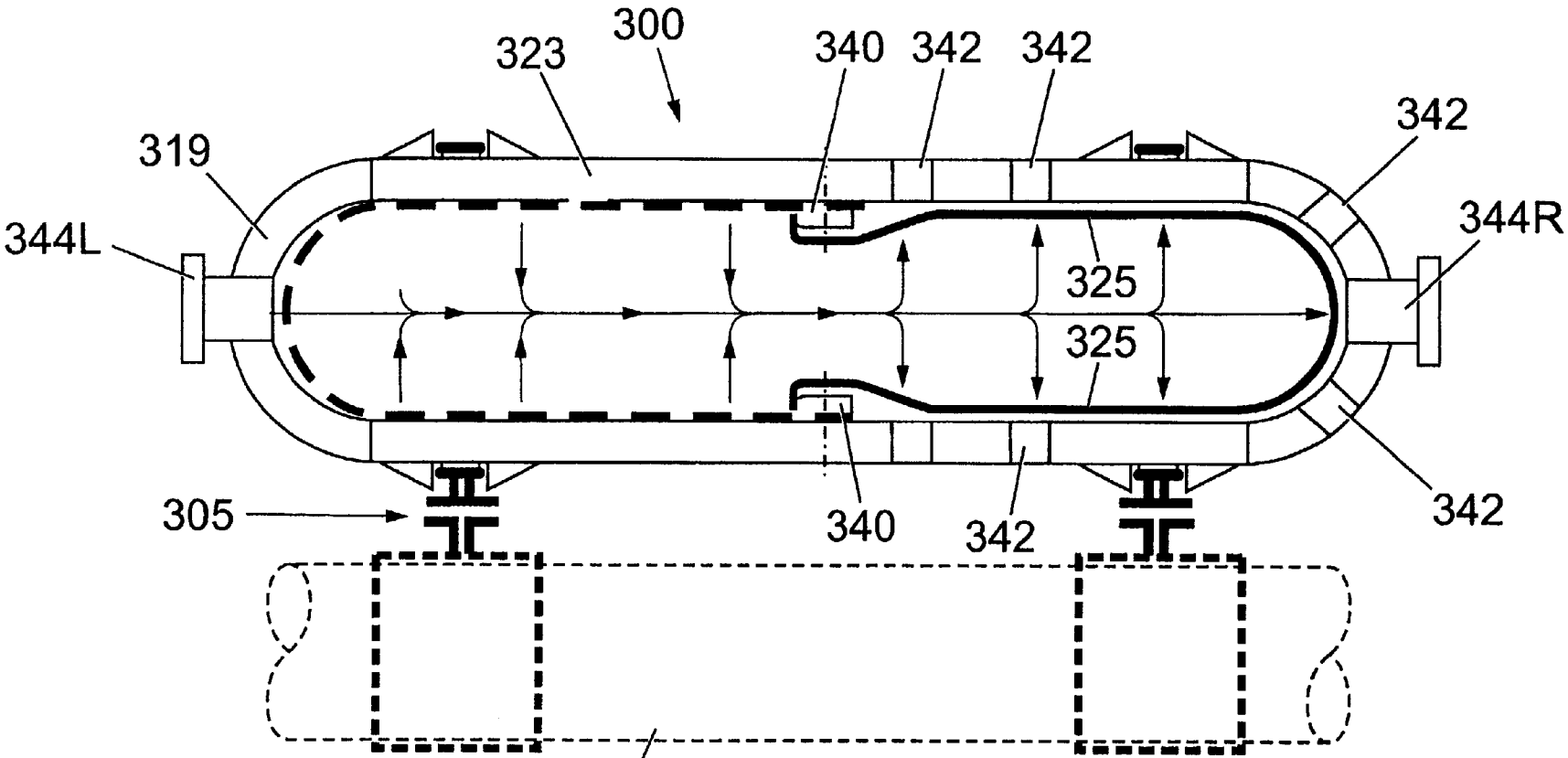
FIG. 21 is a cross-sectional plan view of a fourth embodiment of a buoyancy device in accordance with the present invention.

FIG. 21 shows a-fourth embodiment of a buoyancy device 300 attached in a parallel orientation to a structure, such as a leg 301 of an offshore drilling structure, requiring to be lifted from the ocean floor and removed to a remote location. The buoyancy device 300 are used for substantially the same purposes as the buoyancy devices 100 and 200 herein described above. The buoyancy device 300 is attached to the structure 301 by means of a suitable clamp unit 305, and which may be similar to the clamp unit 205 herein described above.

The buoyancy device comprises at least one buoyancy member 319 which in turn comprises a preferably rigid outer hull 323, which may be formed from a suitable material such as glass reinforced plastic (GRP), carbon fibre, or any other suitable material. Located within the hull 323 is an inflatable bladder or diaphragm 325 and which is akin to a sock. It should be noted in FIG. 21 that the diaphragm 325 is shown in two positions, the first position being a fully inflated position and which is shown in solid line, and the second position being a fully deflated position shown in dotted line. The open end of the diaphragm 325 is secured at approximately the mid-point of the longitudinal axis of the hull 323 by means of a bag circumferential joint 340, which is in the form of an annular ring 340. The connection can be at any point on the inside. The diaphragm 325 is secured to the hull 323 at its open end by means of the open end being sandwiched against the inner circumference of the hull 323 and the outer circumference of the circumferential joint 340. The circumferential ring 340 is preferably secured to both the diaphragm 325 and the hull 323 by any suitable means, such as bolts, screws, etc.

As can be seen from FIG. 21, the hull to one side of the circumferential joint (the right hand side) is provided with water vent holes 342 formed in its side walls, and although six water vent holes 342 are shown, it will be understood that one, or any number more than one of water vent holes will suffice. As also can be seen from FIG. 21, the other side (the left hand side as shown in FIG. 21) of the hull with reference to the circumferential joint is not provided with vent holes, and has full integrity to its side wall.

A manhole cover 344 is provided at both ends of the hull 323, where the manhole cover can be removed, for instance by backing off a screwthreaded connection between the manhole cover 344 and the hull 342, to permit access to the inner hull 323. In this way, the circumferential joint 340 and the diaphragm 325 can be installed within the inner hull 323. The manhole cover 344R to the right hand side of the circumferential joint 340 as shown in FIG. 21 is typically not provided with a valve therein, whilst the manhole cover 344L at the left hand side of the circumferential joint 340 is typically provided with a valve (not shown). Inflation apparatus (not shown) which typically includes an airline inlet and airline outlet, is coupled to the valve of the manhole cover 344L and in this way, inflatable fluid such as air can be introduced into the left hand side of the hull 323.

The diaphragm 325 is shown in an uninflated state in dotted line, and hence when the buoyancy device 300 is located in the water, water will flow into the right hand side of the hull 323 through the water vent holes 342, thus filling up the right hand side of the hull 323 and hence diaphragm 325. When buoyancy of the buoyancy device 300 is required, a controlled amount of air is inserted into the valve, and hence the diaphragm 325 is inflated and moves from left to right until the diaphragm 325 is fully inflated, and this position is shown with the diaphragm 325 in solid line in FIG. 21.

The diaphragm 325 is formed from any suitable material.

Therefore, the buoyancy device 300 has the advantage that the hull 323 prevents over inflation of the diaphragm 325. A plurality of buoyancy devices 300 may be provided as previously described for the other embodiments of the invention.

Modifications and improvements may be made to the foregoing without departing from the scope of the invention. For instance, at least one, more than one or all of the bags 109, 225 or buoyancy members 219, 319 may be arranged to be a "digital" bag or buoyancy member in that the bag or buoyancy member can be arranged by the control system to be either fully inflated or fully deflated. For instance, if ten bags or buoyancy members were provided with each having a 70 tonne lifting capacity and nine bags were fully inflated, then the overall lifting capacity is 630 tonnes. In addition to the "digital" bags or buoyancy members, there may be provided a buoyancy control device which could consist of a cylinder which can be pumped with air to provide a highly variable buoyancy from e.g. 0 tonnes up to 70 tonnes. Alternatively, the said buoyancy control device could be replaced by, or supplemented by, a series or range of differently sized "digital" bags or buoyancy devices such as bags having 1 tonne, 5 tonne, 10 tonne and 20 tonne lifting values.

This arrangement of "digital" bags or buoyancy members provides a greater degree of control over the lifting or sinking of the structure.

It should also be noted that the features of the dependent claims can be combined with one or more of the independent claims, and that the features of the independent claims can be combined with one another.

What is claimed is:

1. A buoyancy device comprising a buoyancy member for attachment to a structure to be floated or sunk, the buoyancy member comprising a restriction device and an inflatable member located substantially within the restriction device, such that the restriction device restricts inflation of the inflatable member;

wherein the buoyancy device is arranged such that when the inflatable member is deflated, water from outwith the device is permitted to enter the restriction device and act upon a first surface of the inflatable member, such that the water is capable of moving the inflatable member to a deflated configuration;

wherein one end of the inflatable member is in fluid communication with a fluid port; and in order to inflate the inflatable member, an inflating fluid is permitted to enter the inflatable member through the fluid port and is capable of acting upon a second surface of the inflatable member and is further capable of moving the inflatable member toward the inflated configuration thereby displacing the water from the restriction device.

2. A buoyancy device according to claim 1, wherein the inflatable member is a diaphragm.

3. A buoyancy device according to claim 1, wherein the restriction device permits the ingress and egress of fluid from within the device.

4. A buoyancy device according to claim 1, wherein the restriction device has at least one aperture in a sidewall thereof to permit fluid to flow therethrough.

5. A buoyancy device according to claim 1, wherein water located outwith the restriction device is permitted to enter the restriction device and act upon the outer surface of the inflatable member.

6. A buoyancy device according to claim 1, wherein the restriction device is of a substantially tubular nature.

7. A buoyancy device according to claim 1, wherein one end of the inflatable member is secured to a portion of the restriction device.

8. A buoyancy device according to claim 1, wherein the inflatable member is secured to the interior of the restriction device.

9. A buoyancy device according to claim 1, wherein the fluid port is a fluid inlet and outlet port.

10. A buoyancy device according to claim 1, wherein at least one aperture is formed in the sidewall of the restriction device, and the water is permitted to enter the restriction device through the said at least one aperture.

11. A buoyancy device according to claim 10, wherein a plurality of apertures are formed in the sidewall along the length of the restriction device.

12. A buoyancy device according to claim 10, wherein the aperture is formed in an end of the restriction device.

13. A buoyancy device according to claim 1, wherein the buoyancy device comprises at least two of said buoyancy members.

14. A buoyancy device according to claim 13, further comprising a control system which controls the inflation of each individual buoyancy member.

15. A buoyancy device according to claim 13, further comprising a control system which, in use, permits variation of the buoyancy of an individual buoyancy member.

16. A buoyancy device according to claim 1, further comprising a coupling member for arrangement around, at least one member of a structure to be floated, the coupling member having at least one coupling point for coupling to a buoyancy member, wherein the coupling member permits the transfer of loads from the buoyancy device to the member of the structure.

17. A buoyancy device according to claim 16, wherein the coupling member has a plurality of coupling points for coupling to a plurality of buoyancy members.

18. A buoyancy device according to claim 16, wherein the coupling member comprises a bore which locates around at least a portion of the outer surface of the member of the structure.

19. A buoyancy device according to claim 18, wherein the said bore is shaped to substantially correspond to the shape of the outer surface of the member of the structure.

20. A buoyancy device according to claim 16, wherein the coupling member is arranged to clamp around the outer circumference of the member of the structure.

21. A buoyancy device according to claim 16, wherein the coupling member is provided with a locking mechanism to permit the coupling member to be coupled to, and released from, the member of the structure.

* * * * *